US006892955B2

(12) United States Patent
Grabandt

(10) Patent No.: US 6,892,955 B2
(45) Date of Patent: May 17, 2005

(54) FUEL INJECTION DEVICE FOR AN INTERNAL COMBUSTION ENGINE

(75) Inventor: Peter Grabandt, Remseck (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/477,837

(22) PCT Filed: Dec. 17, 2002

(86) PCT No.: PCT/DE02/04606

§ 371 (c)(1),
(2), (4) Date: Nov. 17, 2003

(87) PCT Pub. No.: WO03/078828

PCT Pub. Date: Sep. 25, 2003

(65) Prior Publication Data

US 2004/0144366 A1 Jul. 29, 2004

(30) Foreign Application Priority Data

Mar. 15, 2002 (DE) ..... 102 11 439

(51) Int. Cl.[7] ..... F02M 47/02

(52) U.S. Cl. ..... 239/88; 123/445; 239/124; 239/127; 239/553.2

(58) Field of Search ..... 123/476, 446; 239/127, 124, 95, 96, 88–92, 533.2–533.9

(56) References Cited

U.S. PATENT DOCUMENTS 6,189,509 B1 * 2/2001 Froment ..... 123/467
6,244,245 B1 * 6/2001 Boecking ..... 123/300

* cited by examiner

*Primary Examiner*—Henry C. Yuen
*Assistant Examiner*—Johnny H. Hoang
(74) *Attorney, Agent, or Firm*—Robert Bosch GmbH

(57) ABSTRACT

There is disclose a high-pressure fuel pump and a fuel injection valve connected to it for each cylinder of an internal combustion engine. A pump piston of the pump delimits a working chamber connected to a pressure chamber of the injection valve having a valve element controlling injection openings and movable in an opening direction counter to closing force by pressure prevailing in the pressure chamber. A control valve controls connection of a control pressure chamber with the pump-working chamber delimited by a control piston to a relief chamber. When the injection valve element is closed, the control piston opens a main connection with a large flow cross section and when the injection valve element is open, this control piston closes the main connection, only opening a bypass connection with small flow cross section, the bypass connection is embodied in a housing part delimiting the control pressure chamber.

20 Claims, 3 Drawing Sheets

FUEL INJECTION DEVICE FOR AN INTERNAL COMBUSTION ENGINE

CROSS-REFERENCE TO RELATED APPLICATIONS

This application is a 35 USC 371 application of PCT/DE 02/04606 filed on Dec. 17, 2002.

BACKGROUND OF THE INVENTION

1. Art Field of the Invention

The invention is directed to an improved fuel injection apparatus for an internal combustion engine, 2. Description of the Prior Art A fuel injection apparatus of this kind is known from EP 0 987 431 A2. has a high-pressure fuel pump and a fuel injection valve connected to it for each cylinder of the internal combustion engine. The high-pressure fuel pump has a pump piston that delimits a pump working chamber and is driven into a stroke motion by the engine. The fuel injection valve has a pressure chamber connected to the pump working chamber and an injection valve element that controls at least one injection opening; the pressure prevailing in the pressure chamber can move the injection valve element in the opening direction counter to a closing force in order to open the at least one injection opening. A first electrically actuated control valve is provided, which controls a connection of the pump working chamber to a relief chamber. A second electrically actuated control valve is also provided, which controls a connection of a control pressure chamber to a relief chamber. The control pressure chamber is connected to the pump working chamber via a throttle restriction. The control pressure chamber is defined by a control piston, which is supported on the injection valve element and is acted on in a closing direction of the injection valve element by the pressure prevailing in the control pressure chamber. For an injection of fuel, the first control valve is closed and the second control valve is opened so that high pressure cannot build up in the control pressure chamber and the fuel injection valve can open. When the second control valve is open, though, fuel flows out of the pump working chamber via the control pressure chamber, thus reducing the fuel quantity available for injection out of the fuel quantity supplied by the pump piston and also reducing the pressure available for the injection. It follows from this that the efficiency of the fuel injection apparatus is not optimal.

SUMMARY AND ADVANTAGES OF THE INVENTION

The fuel injection apparatus according to the invention, has the advantage over the prior art that when the second control valve is open for the fuel injection and therefore the fuel injection valve is open, the bypass connection only opens a small flow cross section from the control pressure chamber to the relief chamber and consequently, only a small quantity of fuel flows out, which increases the pressure available for the injection and increases the efficiency of the fuel injection apparatus. A rapid opening and closing of the fuel injection valve is also achieved at the beginning and end of the fuel injection, which is made possible by a rapid pressure decrease or pressure increase in the control pressure chamber upon the opening or closing of the second control valve and which occurs as a result of the controlled main connection with a large flow cross section.

Advantageous embodiments and modifications of the fuel injection apparatus according to the invention are disclosed.

One embodiment makes it easy to control the main connection by means of the control piston, while another facilitates production of the valve seat.

BRIEF DESCRIPTION OF THE DRAWINGS

An exemplary embodiment of the invention is described in detail herein below, in conjunction with the drawings, in which.

DESCRIPTION OF THE PREFERRED EMBODIMENT

Figure 1:
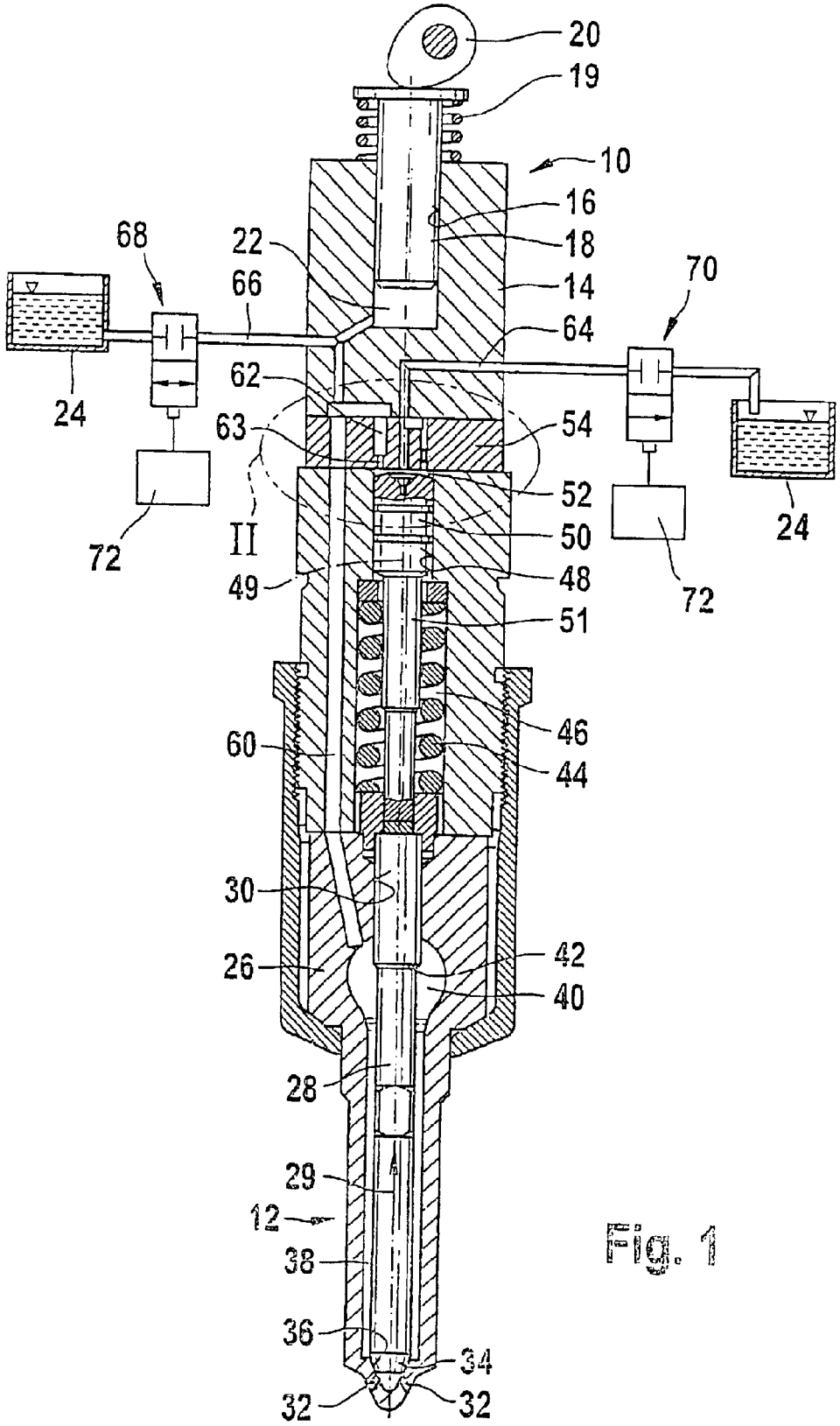
FIG. 1 depicts a simplified longitudinal section through a fuel injection apparatus for an internal combustion engine according to the invention.

FIGS. 1 to 4 show a fuel injection apparatus for an internal combustion engine of a motor vehicle. The engine is preferably an internal combustion engine with autoignition. The fuel injection apparatus is preferably embodied as a so-called unit fuel injector and, for each cylinder of the engine, has a high-pressure fuel pump 10 and a fuel injection valve 12 connected to it, which comprise a common component. Alternatively, the fuel injection apparatus can also be embodied as a so-called unit pump system, in which the high-pressure fuel pump and the fuel injection valve of each cylinder are disposed separately from each other and are connected to each other via a line. The high-pressure fuel pump 10 has a pump body 14 with a cylinder bore 16 in which a pump piston 18 is guided in a sealed fashion, which piston is set into a stroke motion counter the force of a return spring 19, at least indirectly by means of a cam 20 of a camshaft of the engine. In the cylinder bore 16, the pump piston 18 delimits a pump working chamber 22 in which fuel is compressed at high pressure during the delivery stroke of the pump piston 18. The pump working chamber 22 is supplied with fuel from a fuel tank 24 of the motor vehicle.

The fuel injection valve 12 has a valve body 26 that is connected to the pump body 14 and can be composed of a number of parts; an injection valve element 28 is guided in a longitudinally sliding fashion in a bore 30 in this valve body 26. In its end region oriented toward the combustion chamber of the cylinder of the engine, the valve body 26 has at least one injection opening 32, preferably several of them. In its end region oriented toward the combustion chamber, the injection valve element 28 has a sealing surface 34 that is approximately conical, for example, and that cooperates with a valve seat 36 embodied in the end region of the valve body 26 oriented toward the combustion chamber; the injection openings 32 branch off from this valve seat 36 or branch off downstream of it. In the valve body 26, between the injection valve element 28 and the bore 30, toward the valve seat 36, there is an annular space 38 whose end region oriented away from the valve seat 36 transitions—by means of a radial enlargement of the bore 30—into a pressure chamber 40 that encompasses the injection valve element 28. At the level of the pressure chamber 40, the injection valve element 28 has a pressure shoulder 42 formed by a cross sectional reduction. The end of the injection valve element 28 oriented away from the combustion chamber is engaged by a prestressed closing spring 44, which presses the injection valve element 28 toward the valve seat 36. A spring chamber 46 adjoining the bore 30 of the valve body 26 contains the closing spring 44.

At its end oriented away from the bore 30, the spring chamber 46 is adjoined by an additional bore 48 in the valve body 26, in which a control piston 50 is guided in a sealed fashion, which is connected to the injection valve element 28. The control piston 50 functions as a moving wall that delimits a control pressure chamber 52 in the bore 48. The control piston 50 is supported on the injection valve element 28 by means of a piston rod 51 with a diameter smaller than that of the control piston and can be connected to the injection valve element 28. The control piston 50 can be embodied to be of one piece with the injection valve element 28, but for assembly reasons, is preferably embodied as a separate part that is attached to the injection valve element 28.

As shown in FIG. 1, a conduit 60 leads from the pump working chamber 22, through the pump body 14 and the valve body 26, to the pressure chamber 40 of the fuel injection valve 12. A conduit 62 leads from the pump working chamber 22 or the conduit 60 to the control pressure chamber 52. The control pressure chamber 52 also communicates with a conduit 64, which produces a connection to a relief chamber, which function can be served at least indirectly by the fuel tank 24 or another region in which a low pressure prevails. A connection 66 leads from the pump working chamber 22 or the conduit 60 to a relief chamber 24 and is controlled by means of a first electrically actuated control valve 68. The control valve 68 can, as shown in FIG. 1, be embodied as a 2/2-port directional-control valve. The connection 64 of the control pressure chamber 52 to the relief chamber 24 is controlled by a second electrically actuated control valve 70, which can be embodied as a 2/2-port directional-control valve. A throttle restriction 63 is provided in the connection 62 of the control pressure chamber 52 to the pump working chamber 22. The control valves 68, 70 can have an electromagnetic actuator or a piezoelectric actuator and are triggered by an electronic control unit 72.

Figure 4:
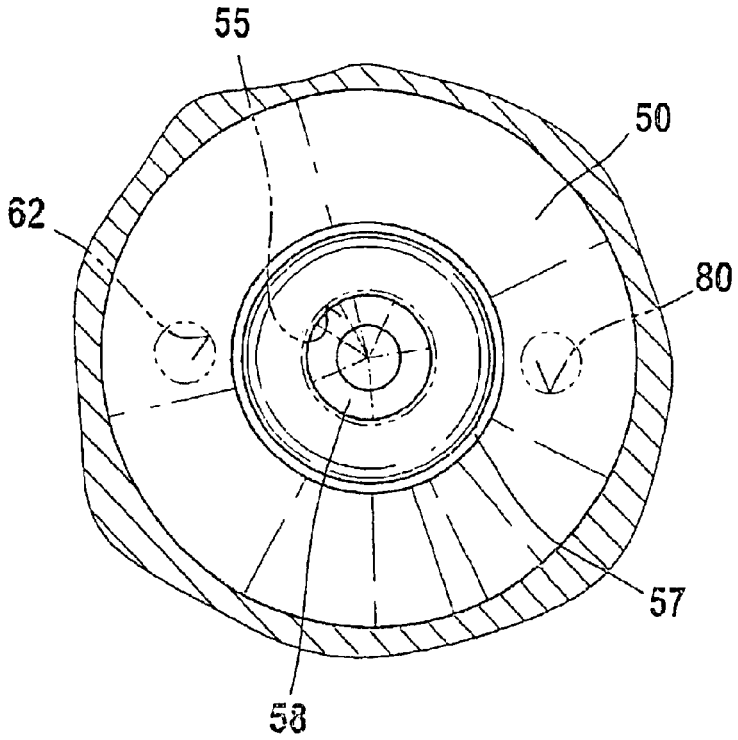
FIG. 4 depicts a cross section of the fuel injection apparatus along line IV—IV in FIG. 2.

Between the pump body 14 of the high-pressure fuel pump 10 and the valve body 26 of the fuel injection valve 12, a housing part is provided in the form of an intermediate disk 54, which constitutes a boundary of the control pressure chamber 52 on its side oriented away from the injection valve element 28. The surface 53 of the intermediate disk 54 that delimits the control pressure chamber 52 is disposed crosswise, preferably at least approximately perpendicular to the longitudinal axis 49 of the control piston 50. The conduit 62 from the conduit 60 to the control pressure chamber 52 is embodied in the intermediate disk 54 and the throttle restriction 63 is embodied as a throttle bore in the conduit 62 in the intermediate disk 54. As shown in FIG. 4, the throttle bore 63 feeds, viewed in the direction of the longitudinal axis 49 of the control piston 50, into an edge region of the control pressure chamber 52 offset from the longitudinal axis 49 of the control piston 50. The intermediate disk 54 contains a bore 55 that constitutes an outlet from the control pressure chamber 52, as part of the connection 64 of the control pressure chamber 52 to the relief chamber 24.

Figure 2:
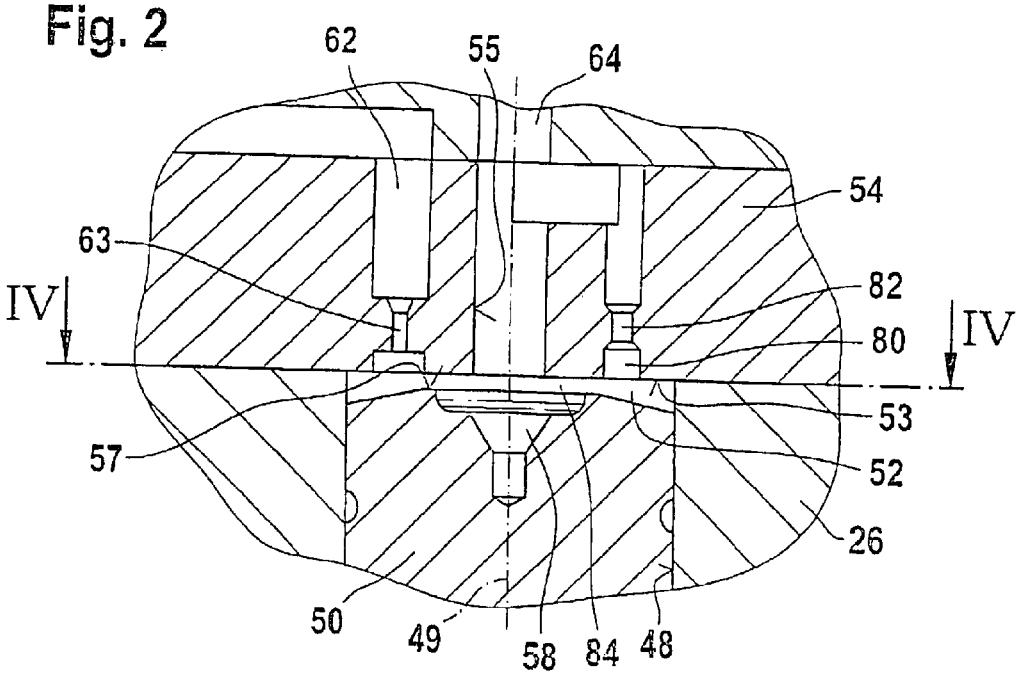
FIG. 2 depicts an enlarged detail, labeled 11 in FIG. 1, when the fuel injection valve is closed.

As shown in FIG. 2, the end surface of the control piston 50 oriented toward the intermediate disk 54 has an annular sealing surface 57, which constitutes a narrow annular rib and is embodied as raised from the end surface of the control piston 50. The annular sealing surface 57 is disposed on a smaller diameter than the outer diameter of the control piston 50. The control piston 50 can be embodied so that its diameter decreases toward the end with the sealing surface 57. Inside the sealing surface 57, the end surface of the control piston 50 can be provided with a recess 58, which can be embodied by means of a blind bore. The sealing surface 57 is disposed at least approximately coaxial to the bore 55 in the intermediate disk 54 and is disposed on a larger diameter than the diameter of the bore 55. The throttle bore 63 in the intermediate disk 54 feeds into the control pressure chamber 52 outside the sealing surface 57 of the control piston 50. The bore 55 in the intermediate disk 54 constitutes an outlet inside the sealing surface 57 of the control piston 50, leading out of the control pressure chamber 52 to the second control valve 70 and via this, to the relief chamber 24. The bore 55 is disposed at least approximately coaxial to the control piston 50.

In addition to the bore 55, for example disposed diametrically opposite from the connection 62 with the throttle restriction 63, the intermediate disk 54 also contains a bypass connection 80 leading out of the control pressure chamber 52 and feeding into the connection 64 to the relief chamber 24. As shown in FIG. 4, the point at which the bypass connection 80 opens into the control pressure chamber 52 lies outside the sealing surface 57 of the control piston 50, viewed in the direction of the longitudinal axis 49 of the control piston 50. The bypass connection 80 contains a throttle restriction 82, which is embodied as a throttle bore. The flow cross section of the bypass connection 80 with the throttle restriction 82 is significantly smaller than the flow cross section of the bore 55.

When the fuel injection valve 12 is closed, then the injection valve element 28 is in a closed position in which its sealing surface 34 rests against the valve seat 36 and closes the injection openings 32. Correspondingly, the control piston 50 is then in a stroke position in which its sealing surface 57 is spaced apart from the surface 53 of the intermediate disk 54 constituting the boundary of the control pressure chamber 52, as shown in FIG. 2.

Between the sealing surface 57 of the control piston 50 and the surface 53 of the intermediate disk 54, there is thus a large flow cross section 84 open for the connection 64 of the control pressure chamber 52 to the second control valve 70. The inlet of fuel into the control pressure chamber 52 from the conduit 60 via the conduit 62 and the throttle bore 63 is limited by the throttle bore 63. The outlet of fuel from the control pressure chamber 52 to the second control valve 70, however, occurs in an unthrottled manner, via the large flow cross section that is opened with the main connection 84 between the sealing surface 57 of the control piston 50 and the intermediate disk 54, thus rendering the bypass connection 80 inoperative.

Figure 3:
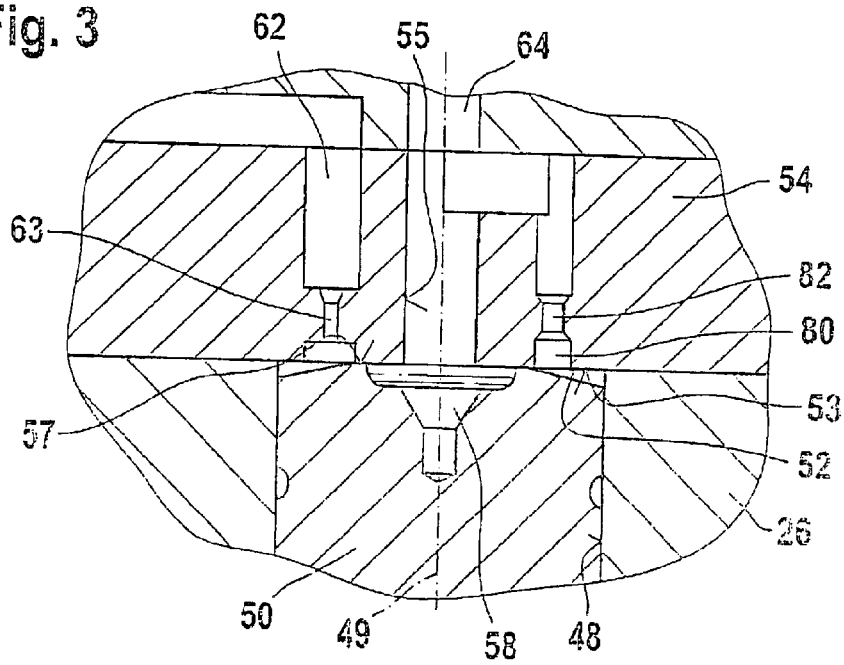
FIG. 3 depicts the detail 11 when the fuel injection valve is open.

When the fuel injection valve 12 is open, then the injection valve element 28 is in an open position in which its sealing surface 34 is spaced apart from the valve seat 36, thus opening the injection openings 32. Correspondingly, the control piston 50 is then in a stroke position in which its sealing surface 57 rests against the surface 53 of the intermediate disk 54, as shown in FIG. 3. The surface 53 of the intermediate disk 54 consequently constitutes a valve seat in the form of a flat seat, which cooperates with the sealing surface 57 of the control piston 50. Because of the narrow, rib-shaped embodiment of the sealing surface 57, it rests essentially with only its edge against the surface 53 of the intermediate disk 54, which produces a linear contact with a high surface pressure and therefore a secure seal. The sealing surface 57 of the control piston 50 and the surface 53 of the intermediate disk 54, which acts as a valve seat, cooperate to control the main connection 84 from the control chamber 52 to the bore 55 in the intermediate disk 54, and this main connection 84 serves to connect the control pressure chamber 52 to the second control valve 70 and the relief chamber 24. This main connection 84 is open when the fuel injection valve 12 is closed and is closed when the fuel injection valve 12 is open.

When the control piston 50 rests with its sealing surface 57 against the surface 53 of the intermediate disk 54 and closes the main connection 84, then only the bypass connection 80 in the intermediate disk 54 remains open, whose flow cross section is limited by the throttle bore 82, which is significantly smaller than the flow cross section of the main connection 84 when this main connection is open.

The cross section of the throttle bore 63 of the connection 62 in the intermediate disk 54 and the throttle bore 82 in the bypass connection 80 in the intermediate disk 54 are suitably matched to each other to permit the fuel injection apparatus to function in an optimal fashion.

The function of the fuel injection apparatus will be explained below. During the intake stroke of the pump piston 18, it is supplied with fuel from the fuel tank 24. During the delivery stroke of the pump piston 18, the fuel injection begins with a preinjection, in which the control unit 72 closes the first control valve 68 so that the pump working chamber 22 is disconnected from the relief chamber 24. The control unit 72 also opens the second control valve 70 so that the control pressure chamber 52 is connected to the relief chamber 24. In this instance, high pressure cannot build up in the control pressure chamber 52 since it is pressure relieved in the direction of the relief chamber 24. If the pressure in the pump working chamber 22 and therefore in the pressure chamber 40 of the fuel injection valve 12 is great enough for the compressive force that it exerts on the injection valve element 28 via the pressure shoulder 42 to exceed the sum of the force of the closing spring 44 and the compressive force exerted on the control piston 50 by the residual pressure prevailing in the control pressure chamber 52, then the injection valve element 28 moves in the opening direction 29 and opens the at least one injection opening 32. The control piston 50 assumes its stroke position depicted in FIG. 3 so that only the bypass connection 80 is opened via the throttle bore 82 with the small flow cross section. Of the fuel delivered by the pump piston 18, therefore, only a small partial quantity can flow to the relief chamber 24 via the throttle bore 63, the bypass connection 80 with the throttle bore 82, and the open second control valve 82. It is also possible for the fuel injection valve 12 to only open with a partial stroke of the injection valve element 28 for the preinjection so that the sealing surface 57 of the control piston 50 does not come into contact with the intermediate disk 54 and does not completely close the main connection 84, but merely reduces its flow cross section.

In order to terminate the preinjection, the control unit closes the second control valve 70 so that the control pressure chamber 52 is disconnected from the relief chamber 24. The first control valve 68 remains in its closed position. As a result, the same high pressure as in the pump working chamber 22 builds up in the control pressure chamber 52 so that a powerful compressive force acts on the control piston 50 in the closing direction and the injection valve element 28 is moved into its closed position.

For a subsequent main injection, the control unit 72 opens the second control valve 70. The fuel injection valve 12 then opens due to the reduced compressive force on the control piston 50, and the injection valve element 28 travels for its maximal opening stroke into its open position. During the opening motion of the injection valve element 28, first the control piston 50 opens the large flow cross section via the main connection 84 until the injection valve element 28 is open with its maximal opening stroke and the sealing surface 57 of the control piston 50 rests against the surface 53 of the intermediate disk 54, thus closing the main connection 84, and only the bypass connection 80 via the throttle bore 82 is open. This permits a rapid opening of the fuel injection valve 12. When the fuel injection valve 12 is completely open, then only a small quantity of fuel can flow to the relief chamber 24 via the throttle bore 63 and the throttle bore 82 so that only a small part of the fuel delivered by the pump piston 18 is unavailable for the injection.

In order to terminate the main injection, the control unit 72 brings the second control valve 70 into its closed position so that the control pressure chamber 52 is disconnected from the relief chamber 24 and high pressure builds up in it so that the fuel injection valve 12 is closed by the force acting on the control piston 50. During the closing motion of the injection valve element 28, the control piston 50 opens the main connection 84 with a large flow cross section so that the pressure in the control pressure chamber 52 increases rapidly and a powerful compressive force acts on the control piston 50, thus causing the fuel injection valve 12 to close rapidly. For a secondary injection of fuel, the control unit 72 opens the second control valve 70 again so that the fuel injection valve 12 opens due to the reduced pressure in the control pressure chamber 52. In order to terminate the secondary injection, the second control valve 70 is closed and/or the first control valve 68 is opened.

The foregoing relates to preferred exemplary embodiments of the invention, it being understood that other variants and embodiments thereof are possible within the spirit and scope of the invention, the latter being defined by the appended claims.

What is claimed is:

1. In a fuel injection apparatus for an internal combustion engine, a high-pressure fuel pump (10) and a fuel injection valve (12) connected to it for each cylinder of the engine, wherein the high-pressure fuel pump (10) has a pump piston (18) that is driven into a stroke motion by the engine and delimits a pump working chamber (22), which is supplied with fuel from a fuel tank (24), wherein the fuel injection valve (12) has a pressure chamber (40) connected to the pump working chamber (22) and an injection valve element (28) that controls at least one injection opening (32), and the pressure prevailing in the pressure chamber (40) acts in an opening direction (29) on a pressure surface (42) embodied on this injection valve element (28) and can move the valve element in the opening direction (29) counter to a closing force In order to open the at least one injection opening (32), having a first control valve (68) that controls a connection (66) of the pump working chamber (22) to a relief chamber (24), and having a second control valve (70) that controls a connection (64) of a control pressure chamber (52) of the fuel injection valve to a relief chamber (24), wherein the control pressure chamber (52) is connected to the pump working chamber (22) at least indirectly via a connection (62) that contains a throttle restriction (63), wherein the control pressure chamber (52) is delimited by a control piston (50), which acts in a closing direction on the injection valve element (28), the improvement wherein, in a stroke position in which the injection valve element (28) is in its closed position, the control piston (50) opens a main connection (84) with a large flow cross section in the connection (64) of the control pressure chamber (52) to the relief chamber (24), wherein in a stroke position of the control piston (50) in which the injection valve element (28) is opened by its maximal stroke, the control piston (50) closes the main connection (84) and only a bypass connection (80) with a small flow cross section remains open, and wherein the bypass connection (80) is embodied in a housing part (54) that delimits the control pressure chamber (52).

2. The fuel injection apparatus according to claim 1, wherein the bypass connection (80) in the housing part (54) is embodied as a bore with a throttle restriction (82).

3. The fuel injection apparatus according to claim 1, wherein on its end surface oriented toward the housing part (54), the control piston (50) comprises a sealing surface (57) that cooperates with a valve seat (53) embodied on the housing part (54) in order to control the main connection (84).

4. The fuel injection apparatus according to claim 2, wherein on its end surface oriented toward the housing part (54), the control piston (50) comprises a sealing surface (57) that cooperates with a valve seat (53) embodied on the housing part (54) in order to control the main connection (84).

5. The fuel injection apparatus according to claim 3, wherein the valve seat is constituted by a surface (53) of the housing part (54), which is disposed crosswise, preferably at least approximately perpendicular to the longitudinal axis (49) of the control piston (50).

6. The fuel injection apparatus according to claim 4, wherein the valve seat is constituted by a surface (53) of the housing part (54), which is disposed crosswise, preferably at least approximately perpendicular to the longitudinal axis (49) of the control piston (50).

7. The fuel injection apparatus according to claim 3, wherein the sealing surface (57) of the control piston (50) is embodied as annular and wherein an outlet (55) from the control pressure chamber (52), which outlet is disposed inside the sealing surface (57) and functions as part of the connection (64) of the control pressure chamber (52) to the relief chamber (24), leads through the housing part (54).

8. The fuel injection apparatus according to claim 4, wherein the sealing surface (57) of the control piston (50) is embodied as annular and wherein an outlet (55) from the control pressure chamber (52), which outlet is disposed inside the sealing surface (57) and functions as part of the connection (64) of the control pressure chamber (52) to the relief chamber (24), leads through the housing part (54).

9. The fuel injection apparatus according to claim 5, wherein the sealing surface (57) of the control piston (50) is embodied as annular and wherein an outlet (55) from the control pressure chamber (52), which outlet is disposed inside the sealing surface (57) and functions as part of the connection (64) of the control pressure chamber (52) to the relief chamber (24), leads through the housing part (54).

10. The fuel injection apparatus according to claim 6, wherein the sealing surface (57) of the control piston (50) is embodied as annular and wherein an outlet (55) from the control pressure chamber (52), which outlet is disposed inside the sealing surface (57) and functions as part of the connection (64) of the control pressure chamber (52) to the relief chamber (24), leads through the housing part (54).

11. The fuel injection apparatus according to claim 7, wherein the bypass connection (80) leads out of the control pressure chamber (52) outside the sealing surface (57) and preferably feeds into the outlet (55) in the housing part (54).

12. The fuel injection apparatus according to claim 8, wherein the bypass connection (80) leads out of the control pressure chamber (52) outside the sealing surface (57) and preferably feeds into the outlet (55) in the housing part (54).

13. The fuel injection apparatus according to claim 9, wherein the bypass connection (80) leads out of the control pressure chamber (52) outside the sealing surface (57) and preferably feeds into the outlet (55) in the housing part (54).

14. The fuel injection apparatus according to claim 10, wherein the bypass connection (80) leads out of the control pressure chamber (52) outside the sealing surface (57) and preferably feeds into the outlet (55) in the housing part (54).

15. The fuel injection apparatus according to claim 1, wherein the high-pressure fuel pump (10) and the fuel injection valve (12) comprise a combined component and wherein the housing part (54) is embodied as an intermediate disk disposed between a pump body (14) of the high-pressure fuel pump (10) and a valve body (26) of the fuel injection valve (12).

16. The fuel injection apparatus according to claim 2, wherein the high-pressure fuel pump (10) and the fuel injection valve (12) comprise a combined component and wherein the housing part (54) is embodied as an intermediate disk disposed between a pump body (14) of the high-pressure fuel pump (10) and a valve body (26) of the fuel injection valve (12).

17. The fuel injection apparatus according to claim 3, wherein the high-pressure fuel pump (10) and the fuel injection valve (12) comprise a combined component and wherein the housing part (54) is embodied as an intermediate disk disposed between a pump body (14) of the high-pressure fuel pump (10) and a valve body (26) of the fuel injection valve (12).

18. The fuel injection apparatus according to claim 5, wherein the high-pressure fuel pump (10) and the fuel injection valve (12) comprise a combined component and wherein the housing part (54) is embodied as an intermediate disk disposed between a pump body (14) of the high-pressure fuel pump (10) and a valve body (26) of the fuel injection valve (12).

19. The fuel injection apparatus according to claim 7, wherein the high-pressure fuel pump (10) and the fuel injection valve (12) comprise a combined component and wherein the housing part (54) is embodied as an intermediate disk disposed between a pump body (14) of the high-pressure fuel pump (10) and a valve body (26) of the fuel injection valve (12).

20. The fuel injection apparatus according to claim 15, wherein the high-pressure fuel pump (10) and the fuel injection valve (12) comprise a combined component and wherein the housing part (54) is embodied as an intermediate disk disposed between a pump body (14) of the high-pressure fuel pump (10) and a valve body (26) of the fuel injection valve (12).

* * * * *